United States Patent [19]

Cassidy, Sr.

[11] 4,150,554

[45] Apr. 24, 1979

[54] PANTY HOSE WITH ELASTIC WAIST BAND

[75] Inventor: Edward L. Cassidy, Sr., Burlington, N.C.

[73] Assignee: Alamance Industries, Inc., Burlington, N.C.

[21] Appl. No.: 826,375

[22] Filed: Aug. 22, 1977

[51] Int. Cl.[2] ..... D04B 9/42; D04B 9/54

[52] U.S. Cl. ..... 66/172 E; 66/173; 66/177

[58] Field of Search ..... 66/172 E, 173, 176, 66/177, 180, 202

[56] References Cited

U.S. PATENT DOCUMENTS

| | | | |
|---|---|---|---|
| 1,079,267 | 11/1913 | Scott | 66/173 |
| 1,079,268 | 11/1913 | Scott | 66/173 |
| 2,339,963 | 1/1944 | St. Pierre et al. | 66/173 |
| 2,702,998 | 3/1955 | Purcell | 66/172 E |
| 3,595,034 | 7/1971 | Safrit | 66/176 X |
| 3,906,754 | 9/1975 | Sackman | 66/177 |
| 4,034,580 | 7/1977 | Holder | 66/172 E |
| 4,047,400 | 9/1977 | Thorneburg | 66/173 X |

FOREIGN PATENT DOCUMENTS

| | | | |
|---|---|---|---|
| 1250048 | 9/1967 | Fed. Rep. of Germany | 66/202 |

OTHER PUBLICATIONS

*Research Disclosure*, Feb. 1975, No. 130, p. 26.

*Primary Examiner*—Wm. Carter Reynolds
*Attorney, Agent, or Firm*—Bell, Seltzer, Park & Gibson

[57] ABSTRACT

The outwardly turned two-ply waist band is integrally knit with the upper end of the single-ply panty portion of the panty hose to simulate the appearance of a sewn on elastic waist band of the type usually employed in panty hose and the like. The outer lower edge of the waist band is provided with a tab or free edge portion which covers the connecting or transfer stitch loops joining the lower edge portion of the outer ply to the inner ply of the waist band.

8 Claims, 4 Drawing Figures

PANTY HOSE WITH ELASTIC WAIST BAND

This invention relates generally to a panty hose with an elastic waist band and method of forming the same and more particularly to an outwardly turned two-ply waist band which is formed on the knitting machine and integrally knit with the panty portion of the panty hose to simulate the sewn on elastic waist band normally employed.

It is the usual practice to produce panty hose by knitting a pair of seamless tubular blanks of sufficient length to reach from the waist to the toe of the wearer, slit the seamless blanks in a wale wise direction and from the upper end downwardly, sew together the corresponding slit edges of the two blanks, with or without a crotch patch, to form a seam extending from the waist opening through the crotch area, and then sew an elastic tape or band to the waist opening. This procedure requires that the elastic tape or band be formed in a separate operation and then attached to the upper end of the panty portion of the panty hose by a sewing operation, which increases the cost of producing the panty hose.

To reduce the cost of producing the panty hose, it has been proposed that an inwardly turned two-ply welt type waist band be knit at the upper end of each of the seamless tubular blanks with a spandex type elastic yarn being incorporated in the two-ply welt to provide an elastic waist band. However, the formation of this inwardly turned welt requires a knitting machine having a dial with transfer bits positioned therein. Also, the appearance of this type of waist band is substantially the same as the appearance of the panty portion of the panty hose because the stitch loops formed in the turned welt face outwardly in the same manner as the stitch loops in the panty portion.

With the foregoing in mind, it is an object of the present invention to provide a panty hose with an outwardly turned two-ply waist band and method of forming the same which is integrally knit with the panty portion and may be knit on a circular knitting machine having a single set of needles. The stitch loops of the two-ply waist band face inwardly and provide a contrasting appearance with the outwardly facing stitch loops in the adjacent panty portion. A spandex type elastic yarn is incorporated in spaced apart courses of the waist band to provide coursewise extending ribs simulating the appearance of a sewn on elastic band. A tab or free edge portion is provided at the lower end of the outer ply to cover the connecting or transfer stitch loops and to further aid in providing the appearance of a sewn on elastic waist band.

In accordance with the present invention the inner and outer plies of the waist band contain a lesser number of wales than the adjacent single-ply panty portion and the tab or free edge portion comprises a few courses, some of which contain the same number of wales as the adjacent panty portion. The lower ends of the inner and outer plies of the waist band are joined together by the connecting or transfer stitch loops which are held on selected spaced apart cylinder needles during the knitting of the waist band.

The knitting of the seamless blanks for use in forming the panty hose with an elastic waist band is carried out on a conventional type of circular hosiery knitting machine. The seamless blanks are knit from the top or waist opening forming portion to the toe with the outwardly turned two-ply waist band being formed by first feeding yarn to the needles and forming a make-up selvage edge and then knitting a few courses on selected needles to form a free edge portion. The inner and outer plies of the outwardly turned waist band are then formed by knitting a plurality of courses on selected needles while maintaining the remaining needles, for example every fourth needle, in an inactive position and holding the stitch loops on these inactive needles with the number of courses knit being sufficient to form both plies of the waist band. The inactive needles are then returned to an active position and knitting proceeds on all of the needles to join the stitch loops held on the inactive needles to the first course knit on all needles and to complete the formation of the outwardly turned two-ply waist band. Knitting on all needles then continues to form the single-ply panty portion extending from the outwardly turned two-ply waist band with the free edge portion covering the connecting stitch loops joining the two plies.

Although the outwardly turned two-ply elastic waist band is described and illustrated as being integrally knit with the panty portion of a panty hose, it is to be understood that the integrally knit outwardly turned two-ply waist band may also be applied to other types of lower body garments, such as panties, panty girdles, tights and the like.

Other objects and advantages will appear as the description proceeds when taken in connection with the accompanying drawings, in which FIG. 1 is a perspective view of a seamless blank for use in forming a panty hose with the integrally formed two-ply elastic waist band at the upper end and with the blank being slit in a longitudinal direction, in preparation for formation of the panty hose;

Figure 1:
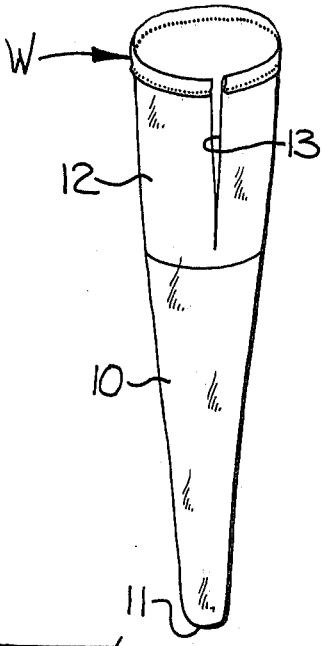
Figure 2:
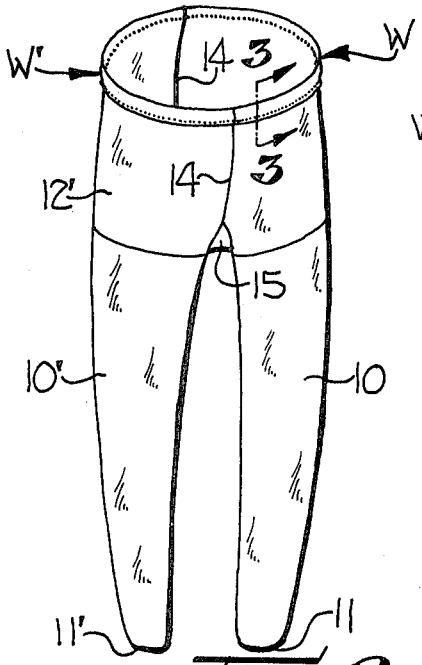
FIG. 2 is a perspective view of the panty hose formed from a pair of seamless blanks of the type illustrated in FIG. 1.

The panty hose is formed from a pair of seamless blanks, as indicated at 10 in FIG. 1 and at 10 and 10' in FIG. 2, which are knit of sufficient length to reach from the waist to the toe of the wearer and include lower closed toe ends 11 and upper panty portion 12, which are usually reinforced. The upper end of the seamless blank 10 is provided with an outwardly turned two-ply elastic waist band, broadly indicated at W, to be presently described in detail. The seamless blank 10 is provided with a longitudinal slit 13 extending downwardly from the upper end and in a walewise direction, as illustrated in FIG. 1.

The corresponding slit edges of a pair of the seamless blanks are then sewn together with a substantially U-shaped seam 14 (FIG. 2) which extends downwardly from the waist opening at the rear, through the crotch area and up the middle of the front to the waist opening. A suitable crotch patch 15 may be sewn into the crotch area of the panty hose as the slit edges are being sewn together by the seam 14.

Figure 3:
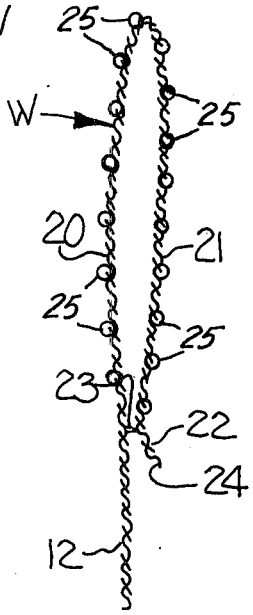
FIG. 3 is a greatly enlarged somewhat schematic vertical sectional view taken through the outwardly turned waist band and along the line 3—3 in FIG. 2.
Figure 4:
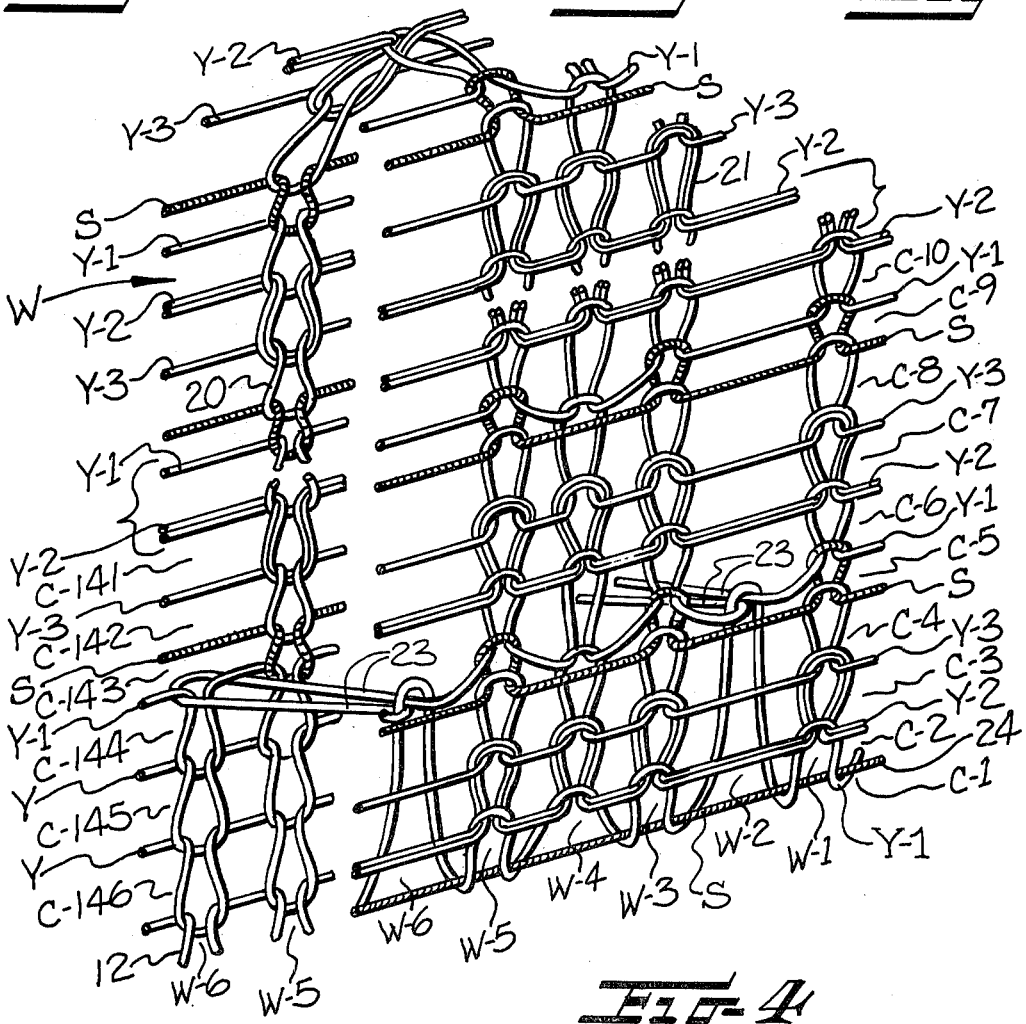
FIG. 4 is a greatly enlarged fragmentary isometric view illustrating the stitch construction of the outwardly turned two-ply waist band with parts broken away.

As indicated in FIGS. 3 and 4, the outwardly turned two-ply waist band includes an inner ply 20 including a lower end integrally knit with the upper end of the single-ply panty portion 12 and the inner ply 20 contains a lesser number of wales than the panty portion. An outer ply 21 is provided with an upper end integrally knit with the upper end of the inner ply 20 and being joined thereto along an upper fold line and the outer ply 21 contains the same number of wales as the inner ply 20. A tab or free edge portion 22 is provided with an upper end integrally knit with the lower end of the outer ply 21 and extends downwardly therefrom. The tab 22 includes only a few courses containing the same number of wales as the panty portion 12, illustrated by courses C-2 and C-6 in FIG. 4. Spaced apart connecting stitch loops 23 join selected wales in the upper end of the single-ply panty portion 12 to corresponding wales in the upper end of the tab 22 so that the lower ends of the inner ply 20 and the outer ply 21 are joined together and the tab 22 extends downwardly over and covers the connecting stitch loops 23. A make-up selvage edge 24 (courses C-1 and C-2 in FIG. 4) is provided on the lower end of the tab 22.

It is preferred that the outwardly turned two-ply waist band W include spandex or other suitable type of elastic yarn, indicated at S and striped in FIG. 4, incorporated, either alone or plated with another yarn, in spaced apart courses to provide inward compressive force against the waist of the wearer to aid in maintaining the same in position while being worn. It is also preferred that the spandex yarn S and/or the body yarns forming at least the outer ply 21 be varied in the sequence of knitting, be varied in size, or be varied in yarn characteristic so that coursewise extending ribs or ridges are formed along the outer surface of the outer ply 21 to simulate the appearance of a separately formed woven or knitted elastic tape. Since the connecting stitch loops 23 are spaced upwardly above the selvage edge 24 and below the tab 22, the outwardly turned two-ply waist band W has the appearance of an elastic tape which has been sewn to the upper end of the panty portion 12.

To aid in understanding the invention, the method of knitting the particular type of outwardly turned two-ply waist band W illustrated in FIG. 4 will be described. However, it is to be understood that variations from this particular construction are also encompassed by the present invention. Also, the knitting of the illustrated outwardly turned two-ply elastic waist band W will be described as being knit on a conventional type of four feed circular hosiery knitting machine with the understanding that the waist band may be knit on circular hosiery knitting machines having a greater or lesser number of feeds.

To begin the knitting of the panty hose blank 10, the spandex yarn S, is initially fed at one knitting station to every other needle so that the spandex yarn S is interlaced in front of and behind every other needle to provide a makeup selvage edge (course C-1). At the next adjacent knitting station, a first textured body yarn Y-1 of a selected denier, for example 70 denier 34 filament texturized nylon, is fed to every needle so that alternate stitch loops are drawn down on one side of the spandex yarn S (wales W-1, W-3 and W-5 of course C-2) and intervening stitch loops are drawn down on the opposite side of the spandex yarn S (wales W-2, W-4 and W-6 of course C-2). At the next adjacent knitting station a second textured body yarn Y-2, of substantially two times the diameter of the first body yarn Y-1, such as two ends of 70 denier 34 filament texturized nylon, is fed to and forms stitch loops in a 3×1 manner so that stitch loops are formed on three adjacent needles (wales W-3, W-4 and W-5 of course C-3) and single wale floats are formed on adjacent sides thereof (wales W-2 and W-6 of course C-3).

At the next adjacent knitting station another first textured body yarn Y-3, of selected denier such as 70 denier 34 filament texturized nylon is fed to and forms stitch loops in a 3×1 manner so that stitch loops are formed on three adjacent needles (wales W-3, W-4 and W-5 of course C-4) and single wale floats are formed on adjacent sides thereof (wales W-2 and W-6 of course C-4). This completes the first rotation of the needle cylinder. During the next rotation of the needle cylinder, the spandex yarn S is again fed to and forms stitch loops on every other needle (in a 1×1 manner) at the first knitting station to form the stitch loops illustrated in the wales W-1, W-3 and W-5 of course C-5 while the stitch loops of the body yarn Y-2 continues to be held on the inactive needles forming the wales W-2 and W-6. As shown in FIG. 4, the spandex yarn S forms floats across the wales W-2, W-4 and W-6 of course C-5.

At the second knitting station the yarn Y-1 is fed to all needles to form the inwardly facing plain stitch loops in wales W-1, W-3, W-4 and W-5 of course C-6 and the connecting stitch loops 23 are formed in wales W-2 and W-6. The connecting stitch loops 23 in wales W-2 and W-6 of course C-6 continue to be held on the inactive needles during the knitting of the outer ply 21 and the inner ply 20. The body yarn Y-2 is again knit at the third knitting station on the groups of three adjacent wales (wales W-3, W-4 and W-5) and floated across the single wales (wales W-2 and W-6) on opposite sides of the three adjacent wales in what is usually referred to as a three by one (3×1) pattern to knit the course C-7. At the fourth knitting station, the body yarn Y-3 is again knit in the three by one pattern to knit the course C-8.

This sequence of knitting is continued with each rotation of the needle cylinder to knit a sufficient number of courses to form the outer ply 21 and the inner ply 20 of the waist band W. However, the needles holding the connecting stitch loops 23 remain inactive during the knitting of both plies of the welt. In FIG. 4 it is indicated that 144 courses are formed to produce the two-ply waist band which is substantially one inch wide. Of course, the width of the waist band W may be increased or decreased, if desired. Also, the width of the tab 22 can be increased, if desired.

After knitting the course C-143 with the spandex yarn S on every other needle, the inactive needles in wales W-2 and W-6 are raised to active position and yarn Y-1 is fed to every needle so that stitch loops are formed through the connecting stitch loops 23 (as illustrated in wale W-6 of course C-144) which have been held on the inactive needles in wales W-2 and W-6 since the knitting of course C-6 at the lower end of the outer ply 21. As the stitch loops are formed in every wale during the knitting of course C-144, the stitch loops in every fourth wale, as indicated in wale W-6, are drawn through the connecting stitch loops 23 to join the lower end of the outer ply 21 to the lower end of the inner ply 20 and to begin the knitting of the upper end of the panty portion 12. Regular panty yarn, indicated at Y, is then fed at each of the four knitting stations to form the plain courses 145 and 146 and subsequent courses while knitting on every needle and to produce outwardly facing stitch loops in every wale.

Thus, both of the outwardly facing surfaces of the outer ply 21 and the inner ply 20 are provided with stitch loops which face inwardly to provide an appearance which is different from the appearance of the outwardly facing stitch loops in the adjacent panty portion 12. Knitting of the leg portion of the seamless blank continues to the toe end 11 when the blank is removed from the knitting machine. The toe end portion 11 may then be closed in any suitable manner and the pair of the blanks longitudinally slit and sewn together, as previously described. Although distinct stitch loops of the spandex yarn S are illustrated in spaced-apart courses, as shown in course C-9 of FIG. 4, it is to be understood that the spandex yarn S is knit under tension so that the stitch loops actually straighten out in the relaxed fabric to draw together the courses immediately adjacent each side of the spandex courses, such as course C-8 of the first textured 70 denier body yarn Y-3 and course C-10 of the first textured 70 denier body yarn Y-1. The second textured body yarn Y-2 is knit in courses, such as course C-7, joining the courses of the first textured body yarns Y-1 and Y-3, as illustrated in respective courses C-6 and C-8. Thus, the spandex yarn S, the first body yarn Y-1 and Y-3, and the second body yarn Y-2 form coursewise extending ridges or ribs schematically indicated at 25 on the outer surface of the two-ply waist band to aid in supporting the same on the waist of the wearer and to also simulate the appearance of the ribs normally found in the elastic tape which is usually sewn onto the upper end of the panty hose.

Although the spandex yarn has been illustrated as being knit in spaced apart wales of selected courses of both of the plies of the outwardly turned waist band, it is to be understood that the spandex yarn may be incorporated in the waist band by other well-known means, such as by inlaying. The spandex yarn may also be incorporated in selected portions of the inner and/or outer plies if desired. The spandex yarn may be incorporated in the panty portion 12 of the blank 10 to provide a support type of panty in the panty hose.

The panty hose of the present invention thus includes an integrally knit outwardly turned two-ply waist band which can be economically formed on a circular hosiery knitting machine to simulate the appearance of an elastic tape sewn to the waist opening of the panty hose. The type of yarn knit in the outwardly turned waist band and/or the type of stitch construction may be varied to produce outwardly extending coursewise ribs which aid in supporting the upper end of the panty hose on the waist of the wearer and also provides the appearance of a separately formed elastic tape.

In the drawings and specification there has been set forth a preferred embodiment of the invention, and although specific terms are employed, they are used in a generic and descriptive sense only and not for purposes of limitation, the scope of the invention being defined in the claims.

That which is claimed is:

1. In a lower body garment including a single-ply panty portion knit of successive courses containing a predetermined number of wales and provided with an upper waist opening, the combination therewith of an outwardly turned two-ply waist band integrally knit with the single-ply panty portion, said two-ply waist band simulating the appearance of an elastic tape and aiding in maintaining the waist opening in position on the wearer, said waist band comprising (a) an inner ply including a lower end integrally knit with the upper end of said single-ply panty portion and containing a lesser number of wales than said single-ply panty portion, (b) an outer ply including an upper end integrally knit with the upper end of said inner ply and containing the same number of wales as said inner ply, (c) a spandex yarn incorporated in spaced apart courses of said outer ply, (d) first textured body yarn of a selected denier knit in courses immediately adjacent each side of said spaced apart courses in which said spandex yarn is incorporated of said outer ply, (e) second textured body yarn of substantially two times the denier of said first textured body yarn and knit in courses joining said courses of said first textured body yarn of said outer ply, said spandex yarn and said first and second body yarns forming coursewise extending ribs on the outer surface of said outer ply to simulate the appearance of an elastic tape, (f) a tab comprising a few courses and including an upper end integrally knit with the lower end of said outer ply and extending downwardly therebelow, (g) spaced apart connecting stitch loops joining selected wales in the upper end of said single-ply panty portion to corresponding wales in the upper end of said tab so that said tab covers said connecting stitch loops, and (h) a make-up selvage edge on the lower end of said tab.

2. In a lower body garment according to claim 1 wherein said spandex yarn incorporated in said selected courses in said outer ply of said outwardly turned two-ply waist band forms knit stitch loops in every other wale of every fourth course.

3. In a lower body garment according to claim 1 wherein said connecting stitch loops are positioned in every fourth wale in the upper end of said tab.

4. In a lower body garment according to claim 1 wherein said tab comprises only four courses.

5. In a panty hose including a pair of seamless knit legs, and a single-ply panty portion knit of successive courses containing a predetermined number of wales and provided with an upper waist opening, the combination therewith of an outwardly turned two-ply waist band integrally knit with the single-ply panty portion, said two-ply waist band simulating the appearance of an elastic tape and aiding in maintaining the waist opening in position on the wearer, said waist band comprising (a) an inner ply including a lower end integrally knit with the upper end of said single-ply panty portion and containing a lesser number of wales than said single-ply panty portion, (b) an outer ply including an upper end integrally knit with the upper end of said inner ply and containing the same number of wales as said inner ply, (c) a spandex yarn incorporated in spaced apart courses of said outer ply, (d) first textured body yarn of a selected denier knit in courses immediately adjacent each side of said spaced apart courses in which said spandex yarn is incorporated of said outer ply, (e) second textured body yarn of substantially two times the denier of said first textured body yarn and knit in courses joining said courses of said first textured body yarn of said outer ply, said spandex yarn and said first and second body yarns forming coursewise extending ribs on the outer surface of said outer ply to simulate the appearance of an elastic tape, (f) a tab comprising a few courses and including an upper end integrally knit with the lower end of said outer ply and extending downwardly therebelow, (g) spaced apart connecting stitch loops joining selected wales in the upper end of said single-ply panty portion to corresponding wales in the upper end of said tab so that said tab covers said connecting stitch loops, and (h) a make-up selvage edge on the lower end of said tab.

6. In a panty hose according to claim 5 wherein said spandex yarn incorporated in said selected courses in said outer ply of said outwardly turned two-ply waist band forms knit stitch loops in every other wale of every fourth course.

7. In a panty hose according to claim 6 wherein said connecting stitch loops are positioned in every fourth wale in the upper end of said tab.

8. In a panty hose according to claim 6 wherein said tab comprises only four courses.

* * * * *